US010688676B2

(12) United States Patent
Sergyeyenko et al.

(10) Patent No.: US 10,688,676 B2
(45) Date of Patent: Jun. 23, 2020

(54) CUTTING CHANNEL GUIDE

(71) Applicant: BLACK & DECKER INC., New Britain, CT (US)

(72) Inventors: Oleksiy Sergyeyenko, Baldwin, MD (US); Tyler Knight, Ellicott City, MD (US); Timothy W. French, Hampstead, MD (US); Chelsea Wills, Baltimore, MD (US); Thomas Wachter, Baltimore, MD (US); Jill Granger, Elkton, MD (US)

(73) Assignee: Black & Decker Inc., New Britain, CT (US)

( * ) Notice: Subject to any disclaimer, the term of this patent is extended or adjusted under 35 U.S.C. 154(b) by 93 days.

(21) Appl. No.: 15/659,677

(22) Filed: Jul. 26, 2017

(65) Prior Publication Data

US 2018/0354148 A1 Dec. 13, 2018

Related U.S. Application Data

(60) Provisional application No. 62/516,803, filed on Jun. 8, 2017.

(51) Int. Cl.
*B26B 29/06* (2006.01)
*D06H 7/04* (2006.01)

(52) U.S. Cl.
CPC ..... *B26B 29/06* (2013.01); *D06H 7/04* (2013.01)

(58) Field of Classification Search
CPC .... G01B 2003/1048; G01B 2003/1087; G01B 3/1041; G01B 3/56
USPC ..... 33/641
See application file for complete search history.

(56) References Cited

U.S. PATENT DOCUMENTS

| | | | | |
|---|---|---|---|---|
| 760,618 | A | 5/1904 | Farmer | |
| 1,341,445 | A | 5/1920 | Stanley | |
| 3,837,084 | A | 9/1974 | Johnson | |
| 3,871,079 | A * | 3/1975 | Magee | B26B 29/06 30/294 |
| 4,096,631 | A * | 6/1978 | Ward | B26B 5/005 30/294 |
| 4,179,808 | A | 12/1979 | Smith | |
| 5,079,842 | A * | 1/1992 | Ward | A47G 27/0487 30/289 |
| 5,404,778 | A * | 4/1995 | Ward | B26B 29/06 30/289 |
| 5,557,996 | A * | 9/1996 | Reber | B25H 7/02 30/292 |
| D430,811 | S * | 9/2000 | DeVos | D10/71 |
| 6,851,196 | B1 * | 2/2005 | Fry Leever | B26B 29/06 30/289 |
| 7,536,803 | B2 * | 5/2009 | Samuels | B26B 15/00 30/289 |
| 9,138,904 | B2 * | 9/2015 | Thomas | B26B 29/06 |
| 2012/0234150 | A1 * | 9/2012 | Holtgreive | B26B 29/06 83/613 |
| 2013/0099438 | A1 | 4/2013 | Mann | |

(Continued)

*Primary Examiner* — Yaritza Guadalupe-McCall
(74) *Attorney, Agent, or Firm* — Stephen R. Valancius

(57) ABSTRACT

A cutting assist device including a first cutting board. The first cutting board has a first side and a second side opposite the first side. The cutting board also includes a cutting channel open to the first side of the first cutting board. The cutting channel allows a portion of a cutting device to be accommodated in the channel while a material placed on the first side is cut by the cutting device.

17 Claims, 9 Drawing Sheets

(56) References Cited

U.S. PATENT DOCUMENTS

| | | | | |
|---|---|---|---|---|
| 2016/0271818 | A1* | 9/2016 | Papiese | B26B 29/06 |
| 2016/0353822 | A1 | 12/2016 | Faupel | |
| 2018/0084952 | A1* | 3/2018 | Eckholm | A47J 47/005 |
| 2018/0354148 | A1* | 12/2018 | Sergyeyenko | D06H 7/04 |

* cited by examiner

CUTTING CHANNEL GUIDE

CROSS-REFERENCE TO RELATED APPLICATION

This application claims the benefit of U.S. Provisional Application No. 62/516,803 filed on Jun. 8, 2017, entitled CUTTING CHANNEL GUIDE. The entire contents of U.S. Provisional Application No. 62/516,803 are incorporated herein by reference.

FIELD OF THE INVENTION

The present invention a tool to aid in the cutting of a material, such as fabric.

BACKGROUND

It is desired to provide a tool which will aid in the cutting of materials, such as fabric.

SUMMARY

According to an aspect of an exemplary embodiment, there is a cutting assist device. The cutting assist device includes at least a first cutting board, the first cutting board having a first side and a second side opposite the first side. The first cutting board includes a cutting channel open to the first side of the first cutting board. The cutting channel is configured to allow a portion of a cutting device to be accommodated in the channel while a material placed on the first side is cut by the cutting device.

There may be a retention strip on the first side of the first cutting board.

The retention strip may be a magnetic strip.

The cutting assist device may further include at least one holding member, the holding member being attracted to the retention strip.

The holding member may have a grip portion configured to be grasped by a user.

The holding member may have a base portion and a magnetic member at the base portion.

The holding member may be removable from the first cutting board.

The second side may include a slip-resisting member.

The first cutting board may include a first end and a second end opposite the first end.

The first cutting board may include at least one pin protruding from the first end.

The cutting assist device may further include a second cutting board, the second cutting board including at least one receiving hold configured to receive the at least one pin to attach the second cutting board to the first cutting board.

The first cutting board may include a first end and a second end opposite the first end and wherein there is at least one receiving hole formed at the second end.

The cutting assist device may further include a second cutting board, the second cutting board including at least one pin protruding from an end of the second cutting board, the at least one pin configured to engage the at least one receiving hole to attach the second cutting board to the first cutting board.

The cutting assist device may further include an end piece, the end piece attaching to the first cutting board at one of the first end and the second end, the end piece including measurement markings.

The end piece may include a slidable measurement tape.

The end piece may include an end piece channel which aligns with the cutting channel of the first board.

The cutting assist device may further include a cutting channel insert that is removably insertable into the cutting channel.

According to an aspect of an exemplary embodiment, there is a cutting assist device. The cutting assist device includes a first cutting board, the first cutting board having a first board top side a first board bottom side opposite the first board top side, the first cutting board further comprising a first board cutting channel open to the first board top side. The cutting assist device further includes a second cutting board, the second cutting board having a second board top side a second board bottom side opposite the second board top side, the second cutting board further comprising a second board cutting channel open to the second board top side.

The first cutting board may be connectable to the second cutting board.

The first cutting board may be connected to the second cutting board, the first board cutting channel and second board cutting channel are aligned to form an elongated cutting channel.

The first cutting board may further include a magnetic strip on the first board top side.

The cutting assist device may further include a holding member which is attracted to the magnetic strip.

The cutting assist device may further include a cutting channel insert that is removably insertable into at least one of the first board cutting channel and the second board cutting channel.

According to an aspect of an exemplary embodiment, there is a cutting assist device including at least a first cutting board, the first cutting board having a first side and a second side opposite the first side. There is a cutting channel open to the first side of the first cutting board, the cutting channel configured to allow a portion of a cutting device to be accommodated in the channel while a material placed on the first side is cut by the cutting device. There is also a magnetic portion on the first side of the first cutting board.

The cutting assist device may include at least one holding member, the holding member being including a grip portion configured to be grasped by a user and a base portion, the base portion having a magnetic member. The magnetic member is attracted to the magnetic portion so as to bias the holding member towards the first side of the cutting board at the magnetic portion.

DETAILED DESCRIPTION OF EXEMPLARY EMBODIMENTS

Figure 1:
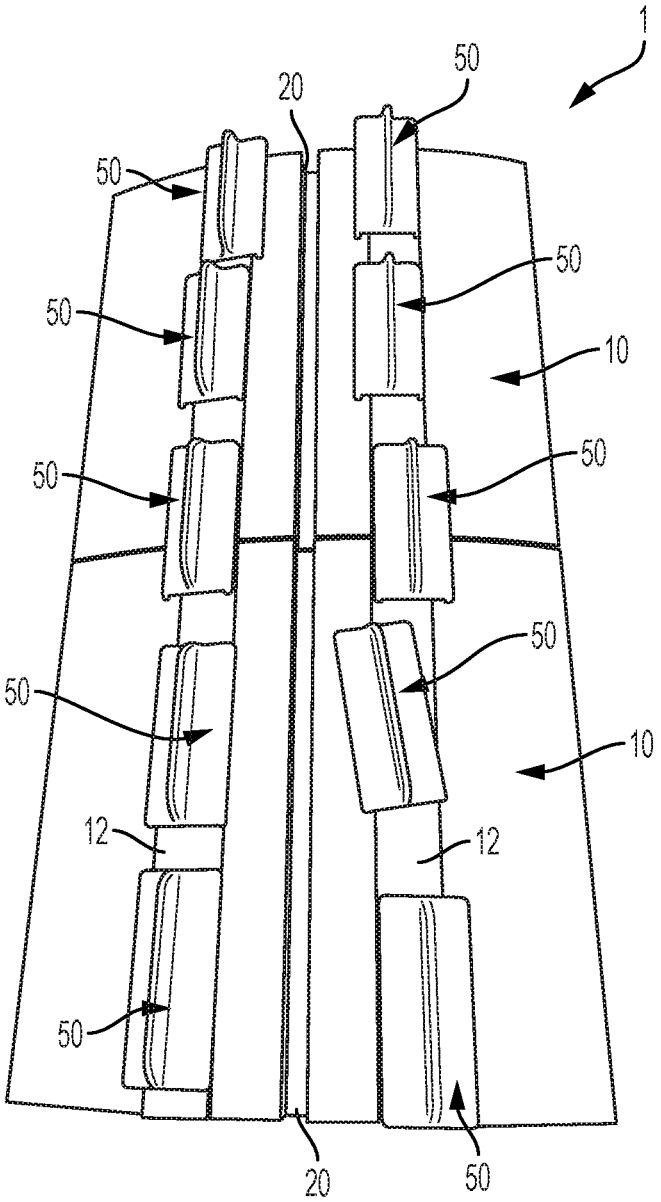
FIG. 1 is a perspective view of a cutting assist device according to an exemplary embodiment.

FIGS. 1-14 illustrate an exemplary embodiment of a cutting assist device 1. The cutting assist device assists a user in cutting a material by holding the material in place while the user cuts the material, as is shown in FIG. 2.

As shown in FIGS. 1-4, the cutting assist device 1 may include one or more cutting device boards 10. The cutting device boards 10 include a pair of magnetic strips 12 on an upward facing side of the board 10. The magnetic strips 12 cooperate with holding members 50 to hold a material in place.

Figure 13:
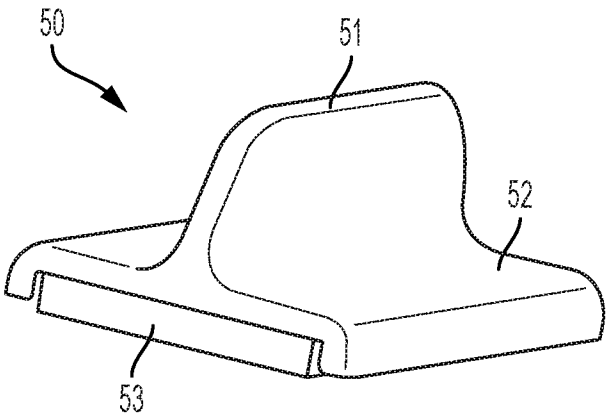
FIG. 13 is another perspective view of a holding member according to an exemplary embodiment.
Figure 14:
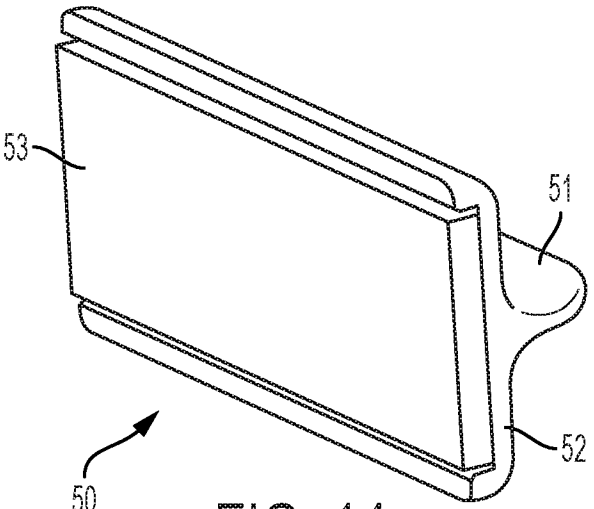
FIG. 14 is another perspective view of a holding member according to an exemplary embodiment.
Figure 12:
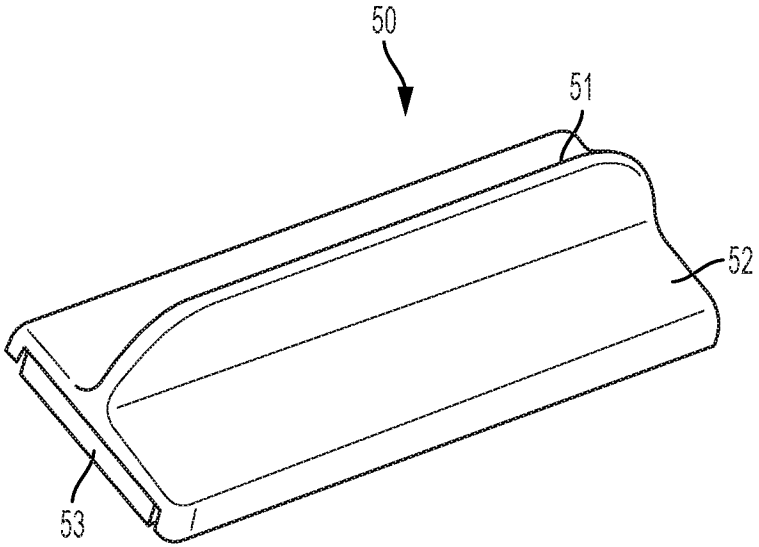
FIG. 12 is a perspective view of a holding member according to an exemplary embodiment.

The holding members are shown close up in FIGS. 12-14. As shown, the holding members 50 include a handle portion 51 and a base portion 52. The handle portion 51 may be gripped by the user to move and place the holding members 50. The base portion 52 houses a magnet 53.

Figure 2:
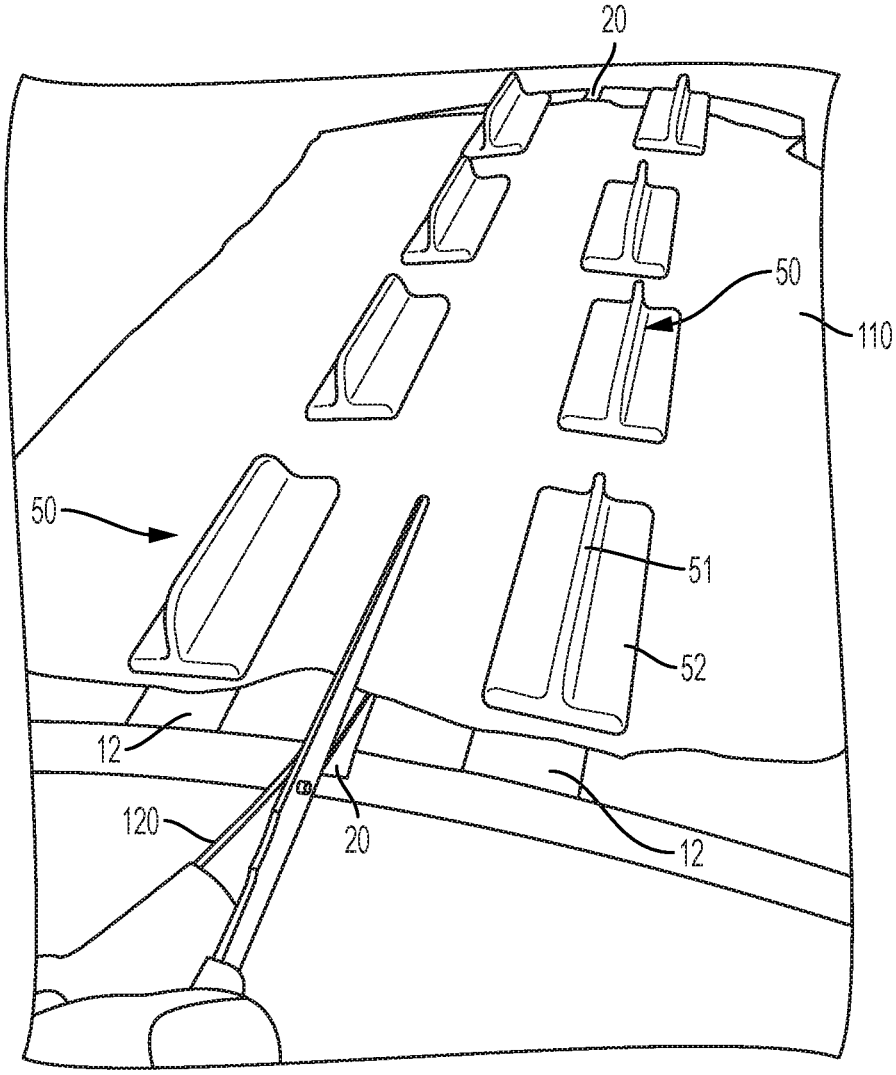
FIG. 2 is another perspective view of the cutting assist device of the exemplary embodiment with a material being cut.
Figure 3:
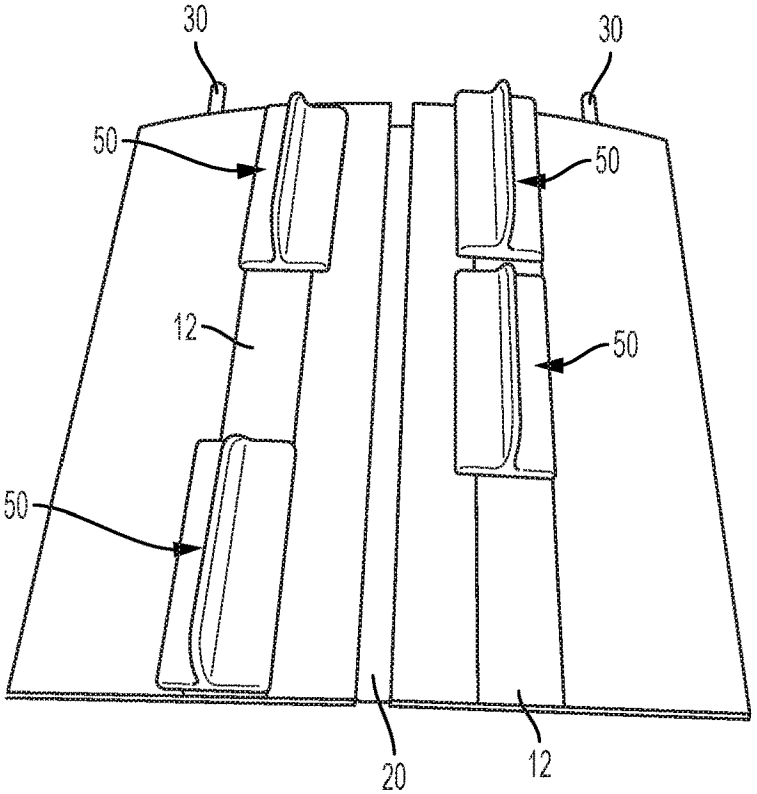
FIG. 3 is another perspective view of the cutting assist device of the exemplary embodiment.

As shown in FIGS. 1-3, the holding members 50 may be placed along the magnetic strip 12. The magnet 53 is attracted to the magnetic strip 12 to bias the holding member 50 towards the magnetic strip 12. Thus, the holding members 50 resist movement. The holding members 50 may alternatively be made of metal or another material which is attracted to the magnetic strips 12.

The cutting device boards 10 also include a cutting channel 20. The cutting channel 20 provides space for scissors 120 or another cutting tool. FIG. 2 shows the cutting assist device 1 in use for cutting a piece of fabric 110 with scissors 120. As shown, the fabric 110 is held to the cutting device boards 10 by the holding members 50. As discussed above, the holding members 50 are attracted to the magnetic strip 12 and thus resist movement.

Figure 4:
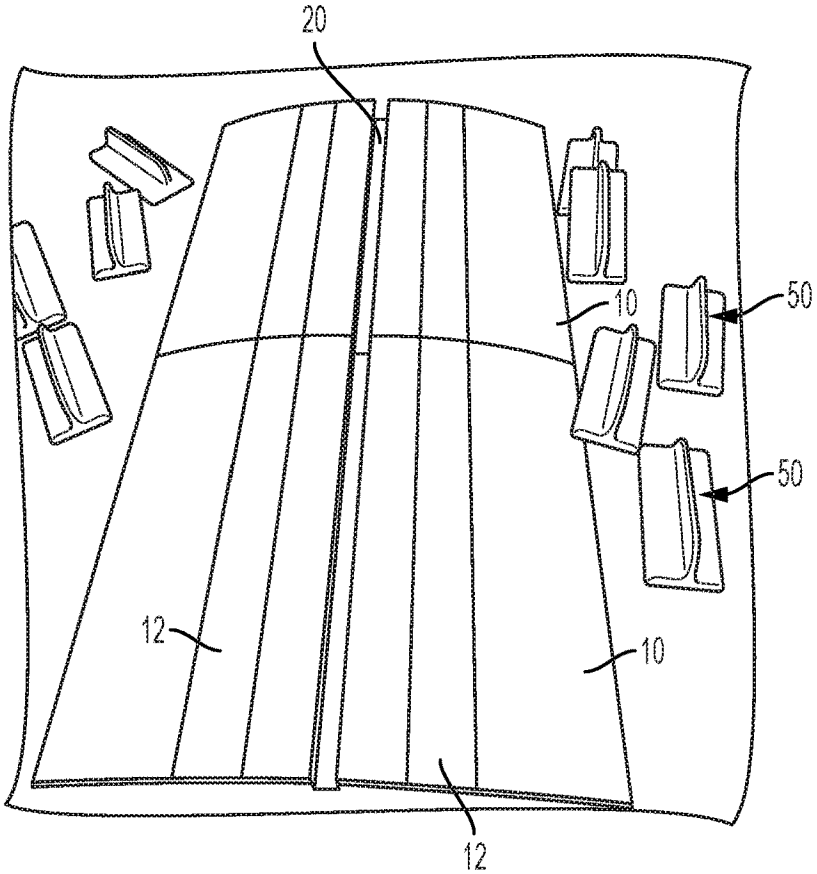
FIG. 4 is another perspective view of the cutting assist device of the exemplary embodiment.

In practice, a user will remove the holding members 50 from the boards 10, as shown in FIG. 4. The user will then place the fabric 110 or another material on the boards 10. The user then places the holding members 50 over the fabric 110 along the magnetic strips 12 to hold the fabric 110 in place. Once that is done, the user can user scissors 120 or another cutting device to cut the fabric, as is shown in FIG. 2. A portion of the scissors 120 can pass below the fabric 110 in the channel 20 to cut the fabric 110 while it is held in place. Other cutting tools, such as a rotary cutter, may be used instead of scissors.

Figure 6:
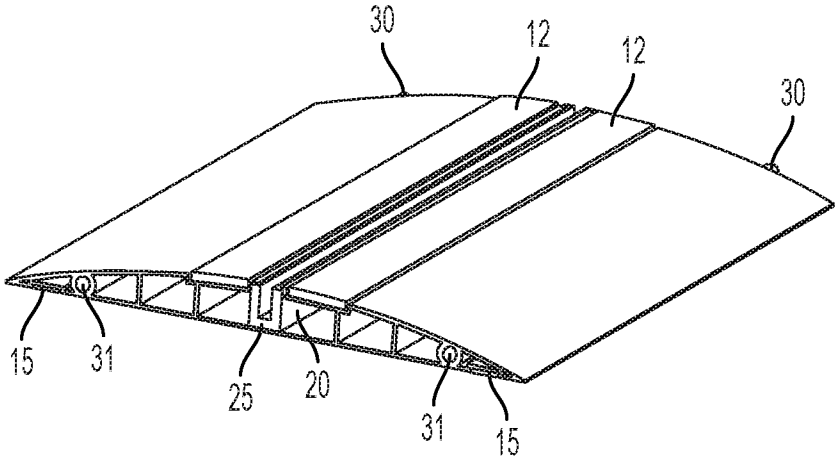
FIG. 6 is a perspective view of the cutting assist device of the exemplary embodiment with a cutting channel insert.
Figure 8:
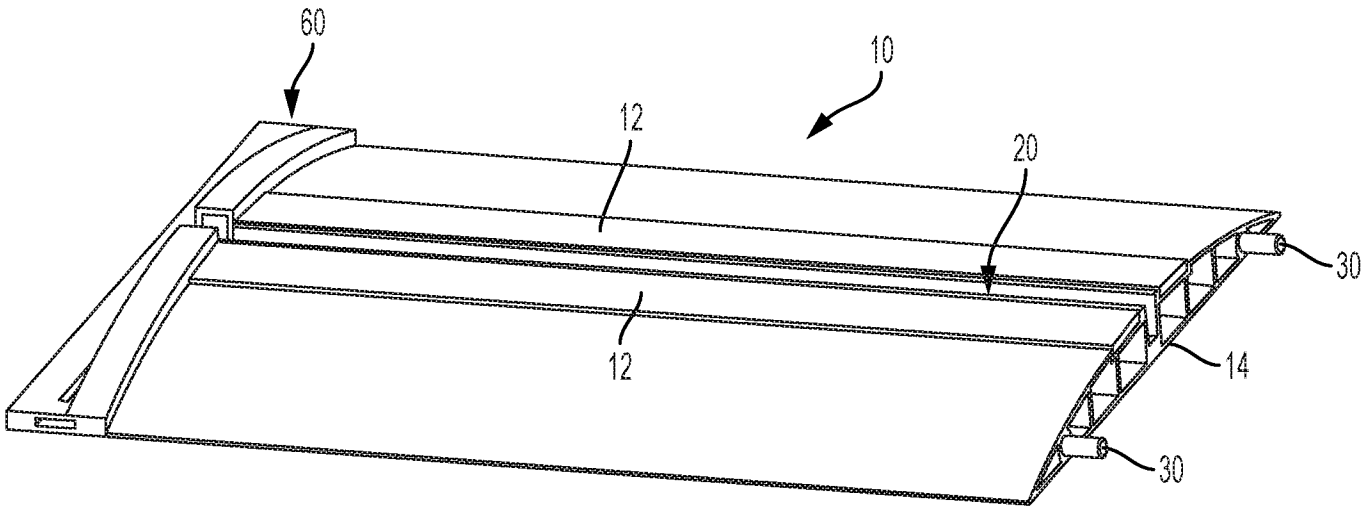
FIG. 8 is a side perspective view of the exemplary embodiment of the cutting assist device with an end member.

The cutting assist device 1 may consist of one or more cutting device boards 10. FIG. 3 shows a single cutting device board 10. The cutting device board 10 includes two pins 30 at one end. The pins 30 can be inserted into corresponding holes 31 in another board 10. FIG. 6 best illustrates the receiving holes 31. This allows the boards 10 to be attached to form a longer cutting assist device 1. For example, two boards 10 can be joined, as shown in FIGS. 1 and 2. When multiple boards are joined, the channels 20 are aligned to form an extended channel. If a longer assembly is required for different tasks, three or more boards 10 can be joined together.

Figure 5:
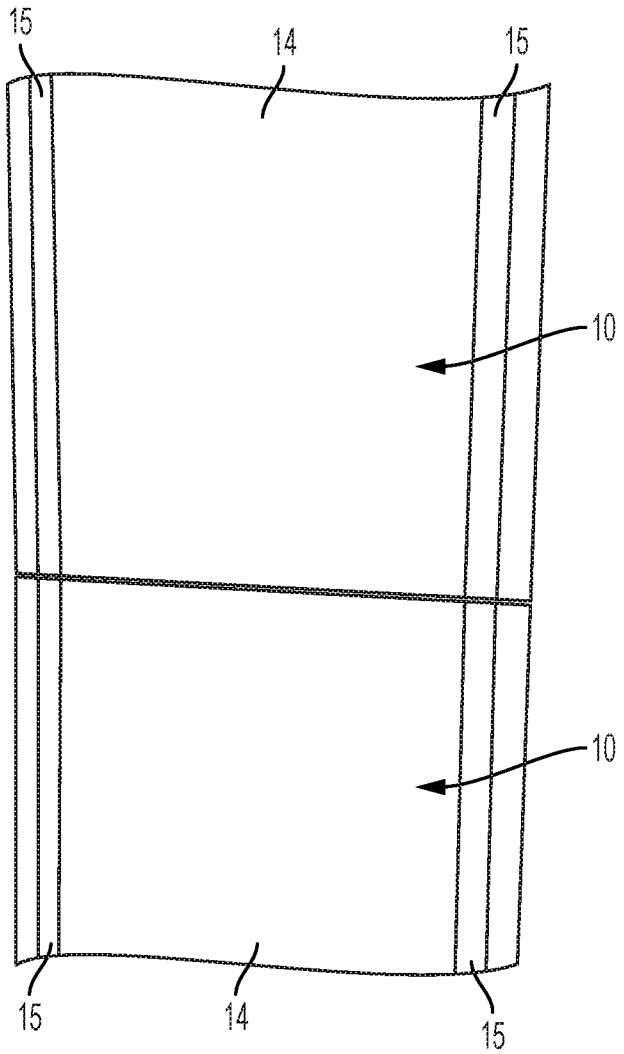
FIG. 5 is a bottom view of the cutting assist device of the exemplary embodiment.

FIG. 5 shows a bottom surface 14 of the boards 10. As shown, the bottom surface includes slide resistant strips 15. The slide resistant strips 15 help prevent the boards 10 from sliding along whatever surface they are place on, such as a table. The slide resistant strips 15 have a co-efficient of friction which is higher than the other material of the bottom surface 14 and may be made of a rubber material.

Figure 7:
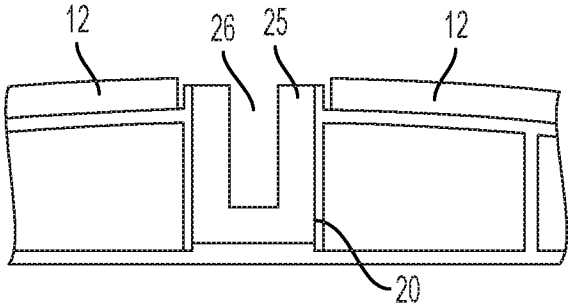
FIG. 7 is a close up view of the cutting channel and cutting channel insert of the exemplary embodiment.

FIGS. 6 and 7 show the cutting board device 10 with a channel insert 25. The channel insert 25 can be inserted into the channel 20 in order to change the effective size of the channel 20. As is shown, when the channel insert 25 is inserted into the channel, the opening 26 is smaller than the opening provided by the channel 20 alone. This may be desirable for different cutting tools or materials. The channel insert 25 is removable, such that it can either be inserted into the channel 20 or removed. Additionally, there may be multiple inserts of different sizes.

Figure 9:
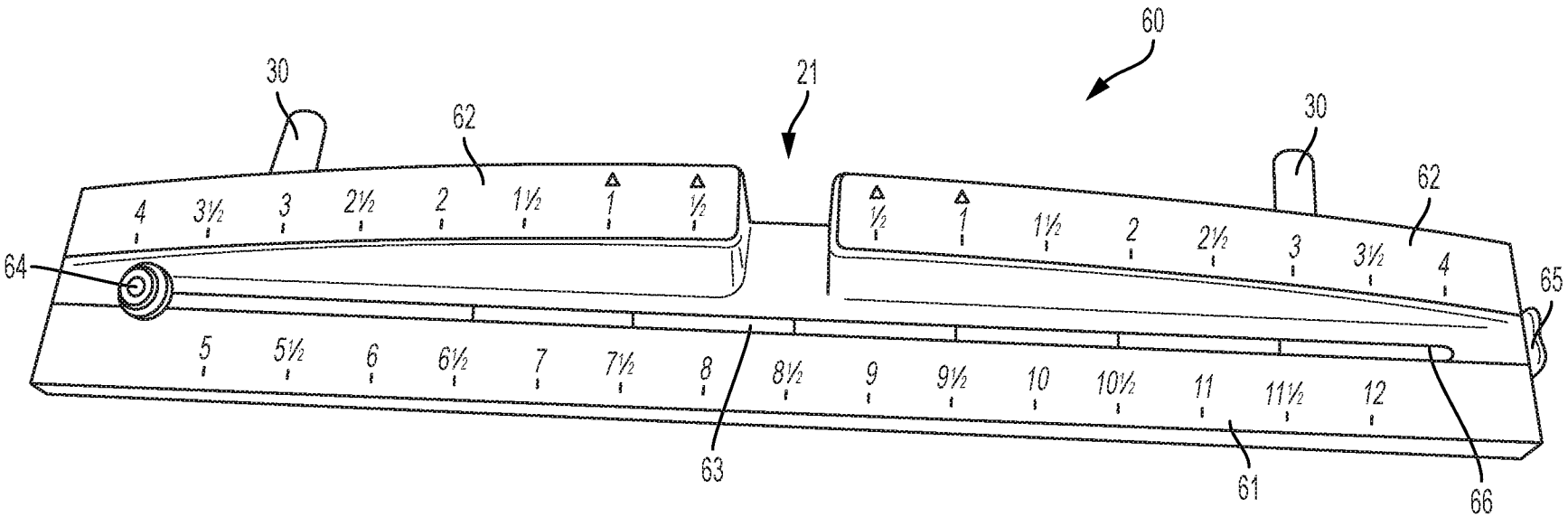
FIG. 9 is a perspective view of the end member of the exemplary embodiment.

As shown in FIGS. 8-11, an end piece 60 may be attached to one end of a cutting board device 10. As shown in FIG. 9, the end piece 60 has a pair of pins 30. The pins 30 are the same size and shape as the pins 30 for the cutting boards 10. Accordingly, the pins 30 of the end piece 60 may fit into the receiving openings 31 on a board 10 to attach the end piece 60 to the board 10.

Figure 11:
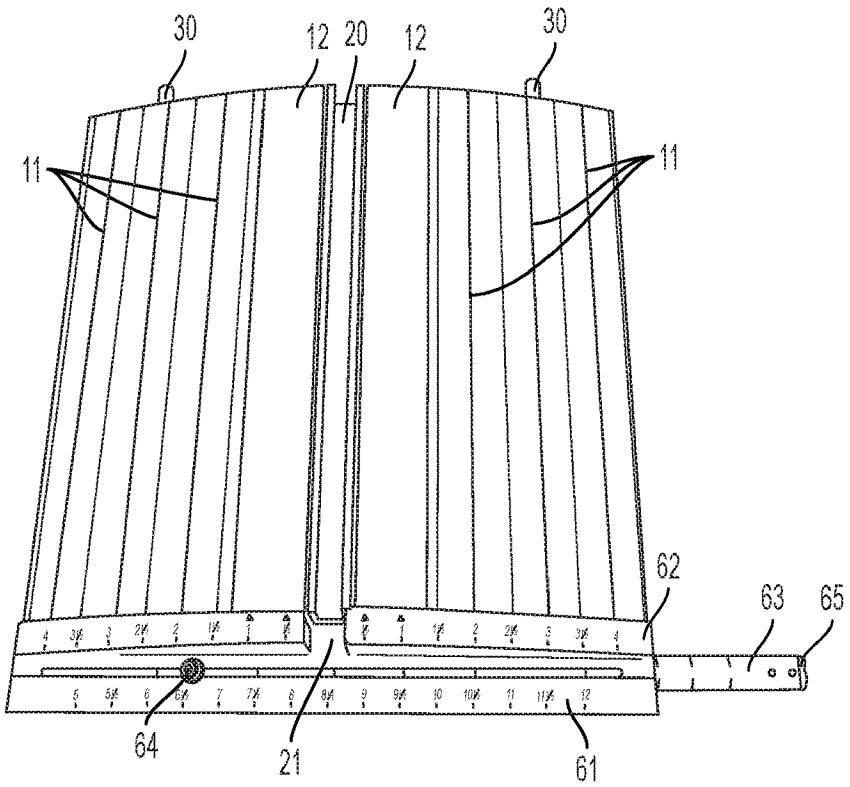
FIG. 11 another front perspective view of the exemplary embodiment of the cutting assist device with an end member.
Figure 10:
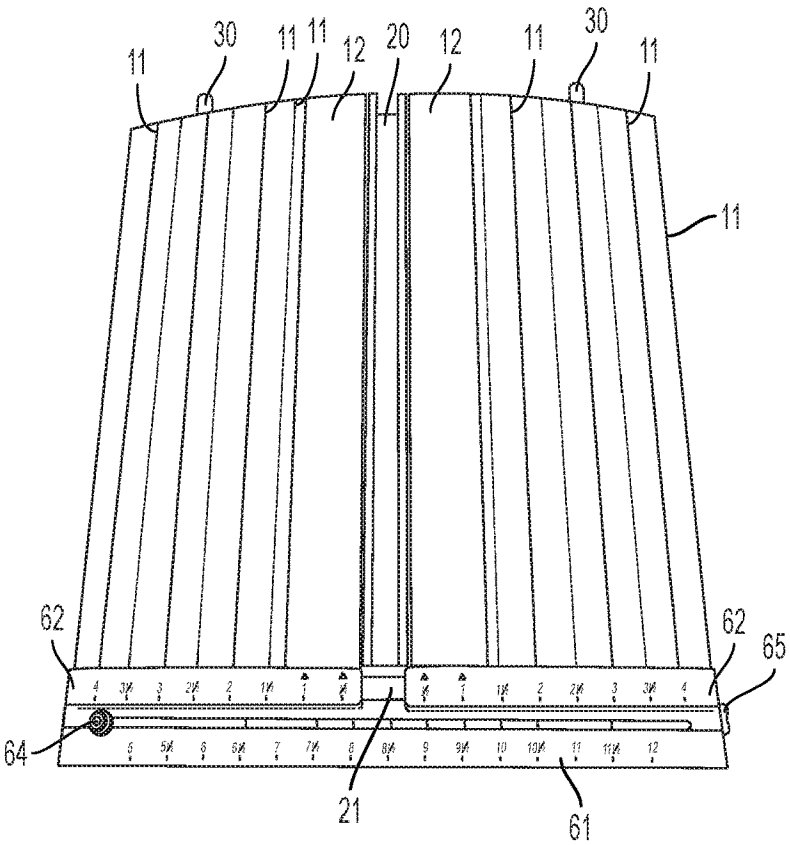
FIG. 10 a front perspective view of the exemplary embodiment of the cutting assist device with an end member.

The end piece 60 includes an end member channel portion 21. As shown in FIGS. 10 and 11, the end member channel portion 21 lines up with the channel 20. The end piece also includes forward measurement markings 62 and rear measurement markings 61. The forward measurement markings can be used to determine how much material is being cut. As shown in FIG. 9, the reference/zero point for the front measurement markings 62 is at the middle of the end member channel portion 21. In the exemplary embodiment shown in FIG. 9, the measurements on the front tapes 62 extend to four (4) inches.

The rear measurement markings 61 allow for extended measurement. The end piece 60 further includes a measurement tape 63 with a rear end 64 and a front end 65 and a slot 66. If the material being cut extends off of the board 10, the tape 63 can be extended, as is shown in FIG. 11. In this position, the location of the rear end 64 of the tape 63 at the rear measurement markings 61 is indicative of the distance from the center of the end member channel portion 21 to the front end 65 of the tape measure. For example, in FIG. 11, the distance from the channel portion 21 to the end of the tape measure 65 is 6½ inches, as indicated by the rear end 64 being next to the 6½ inch marking on the rear measurement markings 61.

With reference to FIGS. 10 and 11, the boards 10 may also include markings 11 which align with the different measurements on the measurement markings.

While the invention has been described by way of exemplary embodiments, it is understood that the words which have been used herein are words of description, rather than words of limitation. Changes may be made within the purview of the appended claims, without departing from the scope and spirit of the invention in its broader aspects.

What is claimed is:

1. A cutting assist device, comprising:

at least a first cutting board, the first cutting board having a first side and a second side opposite the first side;

a cutting channel open to the first side of the first cutting board, the cutting channel configured to allow a portion of a cutting device to be accommodated in the channel while a material placed on the first side is cut by the cutting device;

wherein the first cutting board includes a first end and a second end opposite the first end and wherein there is at least one receiving hole formed at the second end; and further comprising a second cutting board, the second cutting board including at least one pin protruding from an end of the second cutting board, the at least one pin configured to engage the at least one receiving hole to attach the second cutting board to the first cutting board.

2. The cutting assist device of claim 1, further comprising a retention strip on the first side of the first cutting board.

3. The cutting assist device of claim 2, wherein the retention strip comprises a magnetic strip.

4. The cutting assist device of claim 2, further comprising at least one holding member, the holding member being attracted to the retention strip.

5. The cutting assist device of claim 4, wherein the holding member has a grip portion configured to be grasped by a user.

6. The cutting assist device of claim 5, wherein the holding member has a base portion and a magnetic member at the base portion.

7. The cutting assist device of claim 4, wherein the holding member is removable from the first cutting board.

8. The cutting assist device of claim 1, wherein the second side includes a slip-resisting member.

9. The cutting assist device of claim 1, further comprising an end piece, the end piece attaching to the first cutting board at one of the first end and the second end, the end piece including measurement markings.

10. The cutting assist device of claim 9, wherein the end piece includes a slidable measurement tape.

11. The cutting assist device of claim 9, wherein the end piece includes an end piece channel which aligns with the cutting channel of the first cutting board.

12. The cutting assist device of claim 1, further comprising a cutting channel insert that is removably insertable into the cutting channel.

13. A cutting assist device, comprising:

a first cutting board, the first cutting board having a first board top side a first board bottom side opposite the first board top side, the first cutting board further comprising a first board cutting channel open to the first board top side;

a second cutting board, the second cutting board having a second board top side a second board bottom side opposite the second board top side, the second cutting board further comprising a second board cutting channel open to the second board top side;

wherein the first cutting board is connectable to the second cutting board; and wherein, when the first cutting board is connected to the second cutting board, the first board cutting channel and second board cutting channel are aligned to form an elongated cutting channel.

14. The cutting assist device of claim 13, wherein the first cutting board further includes a magnetic strip on the first board top side.

15. The cutting assist device of claim 13, further comprising a holding member which is attracted to the magnetic strip.

16. The cutting assist device of claim 13, further comprising a cutting channel insert that is removably insertable into at least one of the first board cutting channel and the second board cutting channel.

17. A cutting assist device, comprising:

at least a first cutting board, the first cutting board having a first side and a second side opposite the first side;

a cutting channel open to the first side of the first cutting board, the cutting channel configured to allow a portion of a cutting device to be accommodated in the channel while a material placed on the first side is cut by the cutting device;

a magnetic portion on the first side of the first cutting board;

at least one holding member, the holding member being including a grip portion configured to be grasped by a user and a base portion, the base portion having a magnetic member;

wherein the magnetic member is attracted to the magnetic portion so as to bias the holding member towards the first side of the cutting board at the magnetic portion.

* * * * *